US007059497B2

(12) United States Patent
Woods

(10) Patent No.: US 7,059,497 B2
(45) Date of Patent: Jun. 13, 2006

(54) MULTIPLE SIDE-FEEDING AEROSOL VALVE ASSEMBLY

(75) Inventor: John R. Woods, Woodland Hills, CA (US)

(73) Assignee: Spraytex, Inc., Valencia, CA (US)

( * ) Notice: Subject to any disclaimer, the term of this patent is extended or adjusted under 35 U.S.C. 154(b) by 187 days.

(21) Appl. No.: 10/832,126

(22) Filed: Apr. 26, 2004

(65) Prior Publication Data

US 2004/0195277 A1 Oct. 7, 2004

Related U.S. Application Data

(63) Continuation-in-part of application No. 10/174,264, filed on Jun. 18, 2002, now Pat. No. 6,726,066, which is a continuation-in-part of application No. 09/760,990, filed on Jan. 16, 2001, now Pat. No. 6,415,964, which is a continuation-in-part of application No. 09/656,247, filed on Sep. 5, 2000, now Pat. No. 6,382,474, which is a continuation-in-part of application No. 09/312,133, filed on May 14, 1999, now Pat. No. 6,112,945.

(51) Int. Cl.
*B67D 5/52* (2006.01)

(52) U.S. Cl. ..... 222/136; 222/145.5; 222/402.24; 222/402.25; 222/464.1

(58) Field of Classification Search ..... 222/94, 222/95, 136, 145.5, 402.1, 402.24, 402.25, 222/464.1, 464.2
See application file for complete search history.

(56) References Cited

U.S. PATENT DOCUMENTS 3,206,078 A 9/1965 Leimegger ..... 222/434
3,540,623 A * 11/1970 Wittke et al. ..... 222/94
3,615,042 A 10/1971 Marand ..... 222/402.24
3,669,313 A * 6/1972 Marand et al. ..... 222/95
3,674,186 A 7/1972 Ewald ..... 222/402.21
3,704,814 A * 12/1972 Ruscitti ..... 222/136
3,731,847 A * 5/1973 Webster ..... 222/94
3,770,165 A 11/1973 Steinman et al. ..... 222/136
3,806,004 A 4/1974 Kolkovsky ..... 222/385
3,862,705 A * 1/1975 Beres et al. ..... 222/94
3,982,668 A * 9/1976 Riccio ..... 222/95
3,992,003 A * 11/1976 Visceglia et al. ..... 222/94
4,220,258 A 9/1980 Gruenwald ..... 222/46
4,852,807 A 8/1989 Stoody ..... 239/337
5,037,011 A 8/1991 Woods ..... 222/394
5,348,199 A 9/1994 Smith ..... 222/402.19
5,450,983 A 9/1995 Stern et al. ..... 222/1
5,655,691 A 8/1997 Stern et al. ..... 222/402.1

(Continued)

*Primary Examiner*—Joseph A. Kaufman
(74) *Attorney, Agent, or Firm*—Pillsbury Winthrop Shaw Pittman LLP

(57) ABSTRACT

A valve assembly is disclosed for use in an aerosol spray can capable of spraying viscous materials or materials with large particulates without clogging or packing like traditional aerosol spray cans designed for spraying texture materials. The valve opening may be located at substantially any point between the bottom and the top of the container. The valve assembly includes a plurality of side-fitting dip tubes, a side-feeding mechanism, and at least one storage member connected, respectively, to at least one of the dip tubes, whereby texture material is dispensed when a central channel is aligned with a side conduit that is in flow communication with the dip tubes. This allows highly-viscous materials, such as a fire suppressant material, or materials having large particulates, such as stucco, as well as resin/catalyst or blowing-agent/urethane combinations to be sprayed from a single aerosol spray can without clogging.

25 Claims, 16 Drawing Sheets

U.S. PATENT DOCUMENTS

| | | | | |
|---|---|---|---|---|
| 5,715,975 | A | 2/1998 | Stern et al. | 222/402.1 |
| 5,803,319 | A | 9/1998 | Smith et al. | 222/402.19 |
| 5,842,076 | A | 11/1998 | Glover et al. | 396/626 |
| 6,112,945 | A | 9/2000 | Woods | 222/1 |
| 6,375,036 | B1 | 4/2002 | Woods | 222/1 |
| 6,382,474 | B1 | 5/2002 | Woods et al. | 222/402.25 |
| 6,415,964 | B1 | 7/2002 | Woods | 222/402.25 |
| 6,726,066 | B1 | 4/2004 | Woods | 222/402.24 |
| 6,736,288 | B1 * | 5/2004 | Green | 222/94 |
| 2003/0141322 | A1 | 7/2003 | Groeger | 222/402.1 |

* cited by examiner

MULTIPLE SIDE-FEEDING AEROSOL VALVE ASSEMBLY

RELATED APPLICATION DATA

This application is a Continuation-in-part of Ser. No. 10/174,264, filed Jun. 18, 2002, U.S. Pat. No. 6,726,066, which is a Continuation-in-part of Ser. No. 09/760,990, filed Jan. 16, 2001, now U.S. Pat. No. 6,415,964, which is a Continuation-in-part of Ser. No. 09/656,247, filed Sep. 5, 2000, now U.S. Pat. No. 6,382,474, which is a Continuation-in-part of Ser. No. 09/312,133, filed May 14, 1999, now U.S. Pat. 6,112,945.

FIELD OF INVENTION

This invention relates to valve assemblies for use in an aerosol spray can that is capable of spraying viscous materials or materials with large particulates without clogging or packing like traditional aerosol spray cans designed for spraying texture materials.

BACKGROUND OF THE INVENTION

The practice of dispensing heavy and particulate materials through traditional aerosol spray can valve assemblies in the aerosol industry has presented problems in which the heavy and particulate materials to be dispensed clog up the valve assemblies. These heavy and particulate materials may include exterior stucco, heavy sand finishes, drywall and acoustic ceiling patching materials, fire suppressant materials, adhesive and bonding materials, and even culinary sauces.

A traditional aerosol spray can may be filled with these heavy and particulate materials for spraying. In the traditional aerosol spray can, the material to be dispensed must pass through an orifice that is normally sealed off (with a seal or gasket, e.g.) in the unactuated position. When the actuator is depressed, the orifice is exposed to allow the material to pass through. However, when heavy and particulate materials are used, they tend to clog up the valve assemblies (e.g., by clogging up or sticking to the seal, the orifice, and/or the area therebetween) and render the aerosol spray cans inoperative. Constant operation of these aerosol spray cans in spraying heavy and particulate materials is not possible due to inconsistent ability of these traditional valve assemblies to dispense these materials without clogging.

U.S. Pat. No. 5,715,975, issued to Stern et al., discloses an aerosol spray texturing device that is comprised of a container, a nozzle, a valve assembly, and an outlet. The valve assembly in the '975 patent is located in the upper section of the container near the nozzle. Although the nozzle tube of the device in the '975 patent may be configured to spray texture materials, the device in the '975 patent still has the problem of clogging or packing of the valve assembly by the particulates contained in the texture material for spraying, especially if the particulates are large, like those found in stucco or other heavy and particulate materials mentioned above.

U.S. Pat. No. 5,037,011, issued to the present Applicant, discloses a spray apparatus for spraying a texture material through a nozzle. In this apparatus as well there exists a problem of spraying texture materials having large particulates, such as stucco, because the particulates also clog up the valve opening within the spray apparatus.

Therefore, a long-standing need has existed to provide an apparatus that may be used to readily apply heavy and particulate materials in aerosol form, such as exterior stucco, heavy sand finishes, drywall and acoustic ceiling patching materials, fire suppressant materials, adhesive and bonding materials, and culinary sauces. Furthermore, the heavy and particulate materials to be applied should be contained in a hand-held applicator so that the materials may be conveniently stored, as well as dispensed, in a simple and convenient manner without clogging or packing the valve assembly of the applicator.

An object of the present invention, therefore, is to provide a valve assembly for use in an aerosol spray can capable of spraying viscous materials or materials with large particulates without clogging or packing like traditional aerosol spray cans designed for spraying texture materials.

Another object of the present invention is to provide an inexpensive and economical means for matching surface texture of a repaired or patched surface area on a drywall panel, acoustic ceiling, or stucco-covered surface.

Another object of the present invention is to improve the appearance of patched or repaired areas on a textured surface by employing a spray-on hardenable texture material that covers the repaired or patched area and visually assumes the surface texture of the surrounding patched or repaired surface.

Another object of the present invention is to provide a hand-held dispensing unit containing a pressurized texture surface material for spray-on and direct application of the material in a liquid or semi-liquid form onto a repaired or patched area so that the surrounding patched or repaired surface will be visually and mechanically matched.

Another object of the present invention is to provide a valve assembly for use in an aerosol spray can capable of spraying highly-viscous materials, such as fire suppressant materials, adhesive and bonding materials, and culinary sauces, as well as colored agents, resins, catalysts, blowing agent, urethane-type products, and the like, including the ability to spray two different materials from a single can, without clogging or packing like traditional aerosol spray cans when spraying these materials.

One embodiment of the valve assembly comprises a dip tube disposed inside a container. A rod is disposed inside the dip tube so that it may move lengthwise within the dip tube. A sealing member is coupled to the bottom end of the rod, so as to form a tight-seal with the bottom opening of the dip tube when the rod is in an up position, and it exposes the bottom opening of the dip tube to the heavy and particulate material inside the container when the rod is in a down position. A bushing is also coupled to the top opening of the dip tube. Finally, an actuator is coupled to the top end of the rod and the bushing, allowing the user to depress the actuator, thus lowering the rod to its down position and exposing the bottom opening of the dip tube to the material within the container, and allowing the heavy and particulate material to move up the dip tube and out of the container.

Another embodiment of the valve assembly comprises a dip tube disposed inside the container. An interior tube is disposed inside the dip tube so that it may move lengthwise within the dip tube. There is at least one orifice at the bottom end of the interior tube. A top O-ring is coupled to the interior tube adjacent the at least one orifice to prevent any bypass of the heavy and particulate material into the dip tube, and a bottom O-ring is coupled to the bottom end of the interior tube to seal off the valve assembly when not actuated. The top opening of the dip tube is coupled to a bushing. Finally, an actuator is coupled to the top end of the interior tube, allowing the user to depress on the actuator, thus lowering the interior tube to its down position and exposing the at least one orifice on the interior tube to the material inside the container and allowing the heavy and particulate material to flow up the interior tube and out of the container.

In yet another embodiment of the invention, a valve assembly is described wherein the valve opening may be located at substantially any point between the bottom and of the top of the container. The valve assembly includes a side-fitting dip tube and a side-feeding mechanism, whereby texture material is dispensed when a central channel is aligned with a side conduit that is in flow communication with the dip tube. The valve assembly also includes a guiding mechanism to ensure alignment of the central channel and the side conduit in the actuated position. The embodiment just described provides for a much simpler and faster assembly, as well as a reduction in the amount of gas that is lost. In addition, placement of the dip tube on the side (within the container) eliminates the need to build different sizes of valve assemblies to fit a range of container sizes. Thus, a single size of the valve assembly may be produced and dip tubes of various lengths may be used to fit the intended container size. As such, this embodiment also provides a reduction in size and costs associated with the use of multiple container sizes.

In another embodiment of the invention, the valve assembly described immediately above includes two or more side-fitting dip tubes, wherein one of the tubes extends towards the bottom of the container and is in direct contact with the material housed within the container (as described above). Each one of the one or more additional dip tubes, on the other hand, is connected to a storage member, such as a sack or a pouch, which, in turn, is housed within the container. In this way, when the actuating mechanism is activated, a first material (or fraction of material) is drawn through the first dip tube, and a second material (or second fraction of the same material) is drawn through the second dip tube, thereby allowing two different materials (or fractions of material) to be sprayed from a single container. When more than two dip tubes are present, the aerosol container may be used to spray as many different materials (or fractions of materials) from a single container as there are dip tubes by connecting each additional dip tube to a separate storage member within the container.

The invention prevents clogging or packing of the valve assembly by eliminating the need for a seal or gasket which, as was described above, is required in traditional aerosol spray cans. However, the elimination of the gasket, without more, would simply allow the contents near the top the container to leave. That is, provisions must be made to ensure that the entire contents of the container can be dispensed. To this end, in embodiments of the present invention, the valve opening may be at the bottom of the container, as opposed to being at the top, as in traditional aerosol spray cans. In other embodiments, the valve assembly may still be placed near the top of the container, with a dip tube that receives sprayable material from the bottom of the container and feeds the material through a side conduit and an angled channel. The placement of the valve opening as described with respect to the embodiments herein greatly reduces the clogging or packing of the valve by texture materials having large particulates. This improvement allows the efficient and low-cost spraying of more highly-textured materials, because there is no longer the problem of clogging or packing of the valve opening by the particulates suspended within the textured material.

Other features and advantages of the invention will become apparent from the following detailed description, taken in conjunction with the accompanying drawings that illustrate, by way of example, various features and embodiments of the invention.

DETAILED DESCRIPTION

Figure 1:
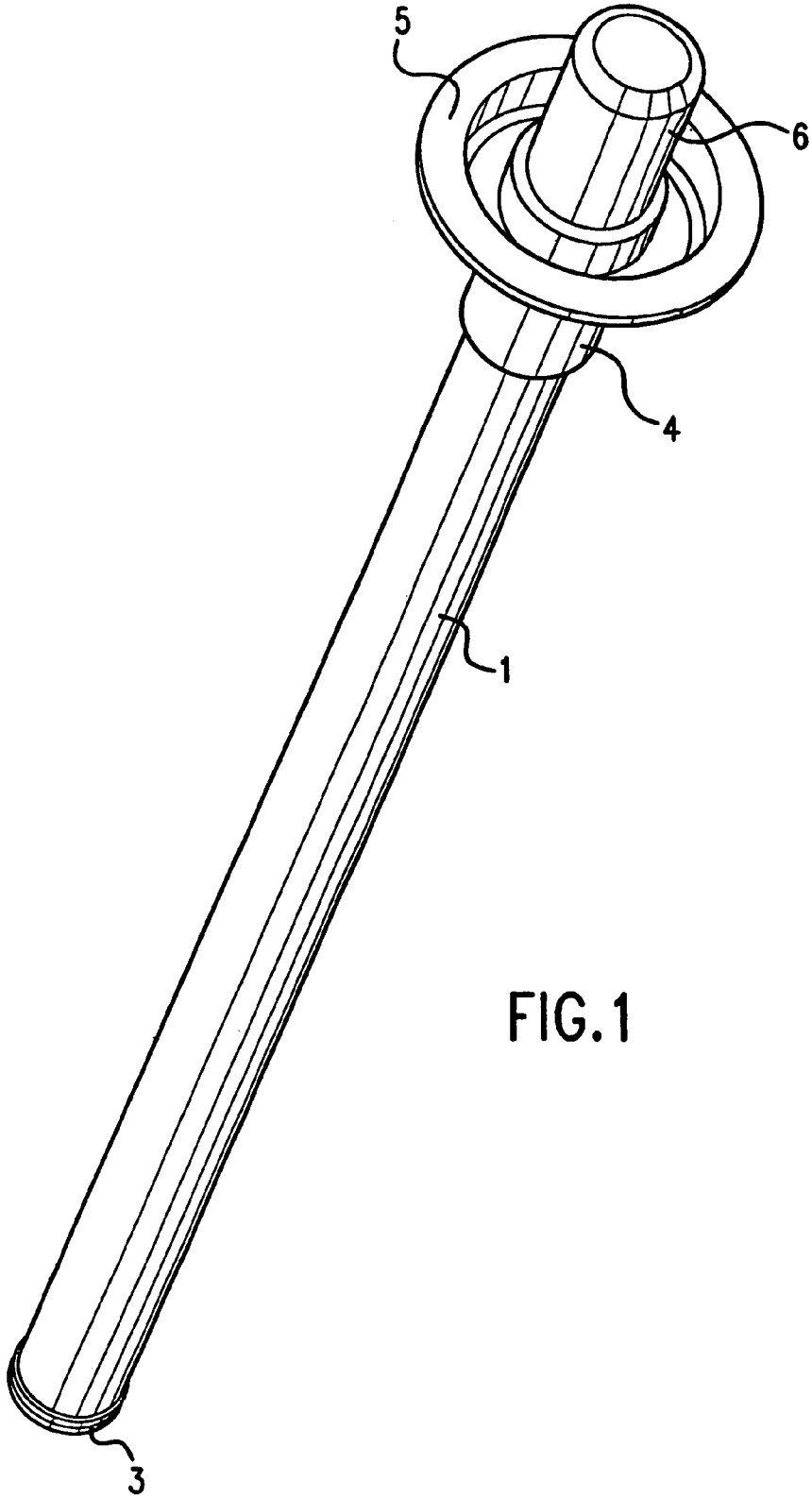
FIG. 1 is a perspective view of a valve assembly in accordance with an embodiment of the present invention.
Figure 3:
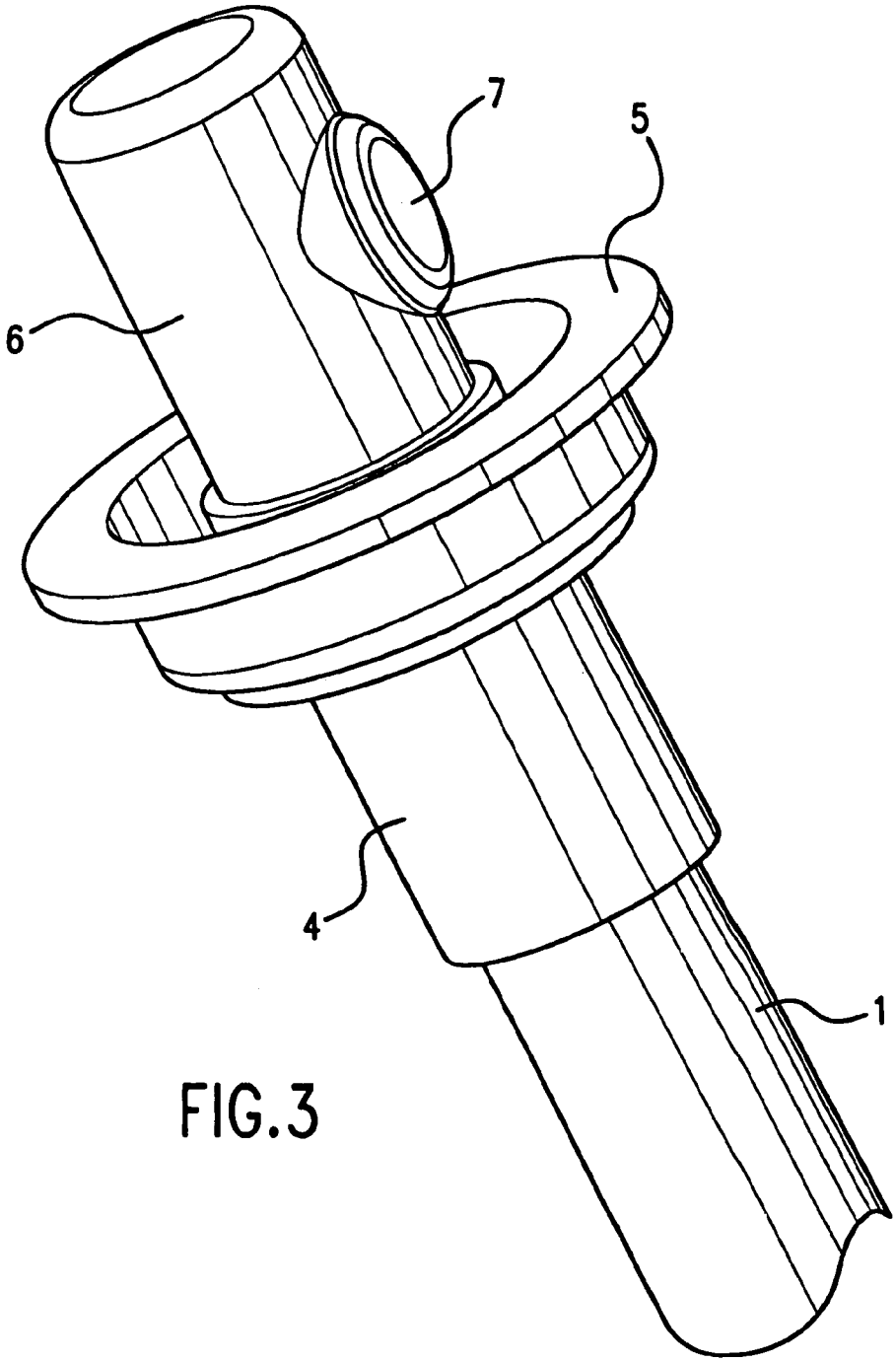
FIG. 3 is a perspective view of a valve assembly in accordance with an embodiment of the present invention.

FIGS. 1 and 3 are perspective views of a valve assembly in accordance with an embodiment of the present invention. A dip tube 1 is coupled to a bushing 4, which may also be coupled to a cup 5. An actuator 6 is also coupled to the bushing 4.

Figure 2:
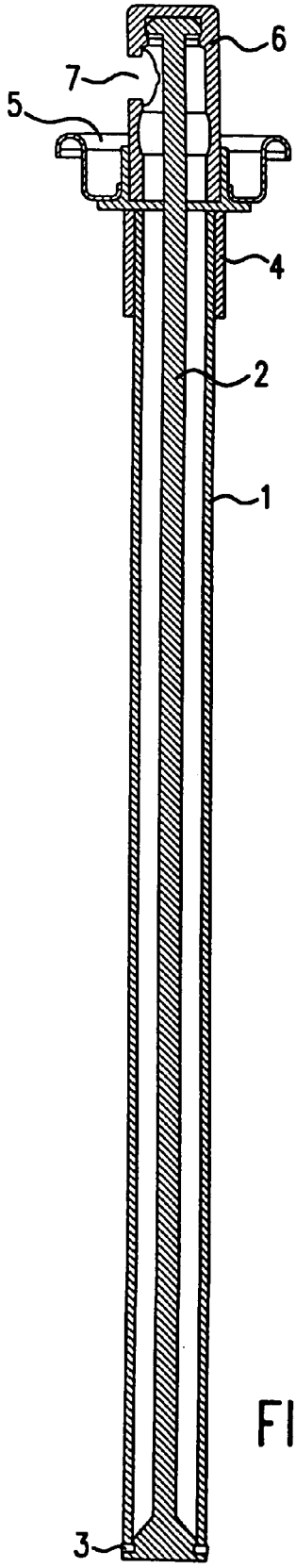
FIG. 2 is a cross-sectional view of a valve assembly in accordance with an embodiment of the present invention.
Figure 4:
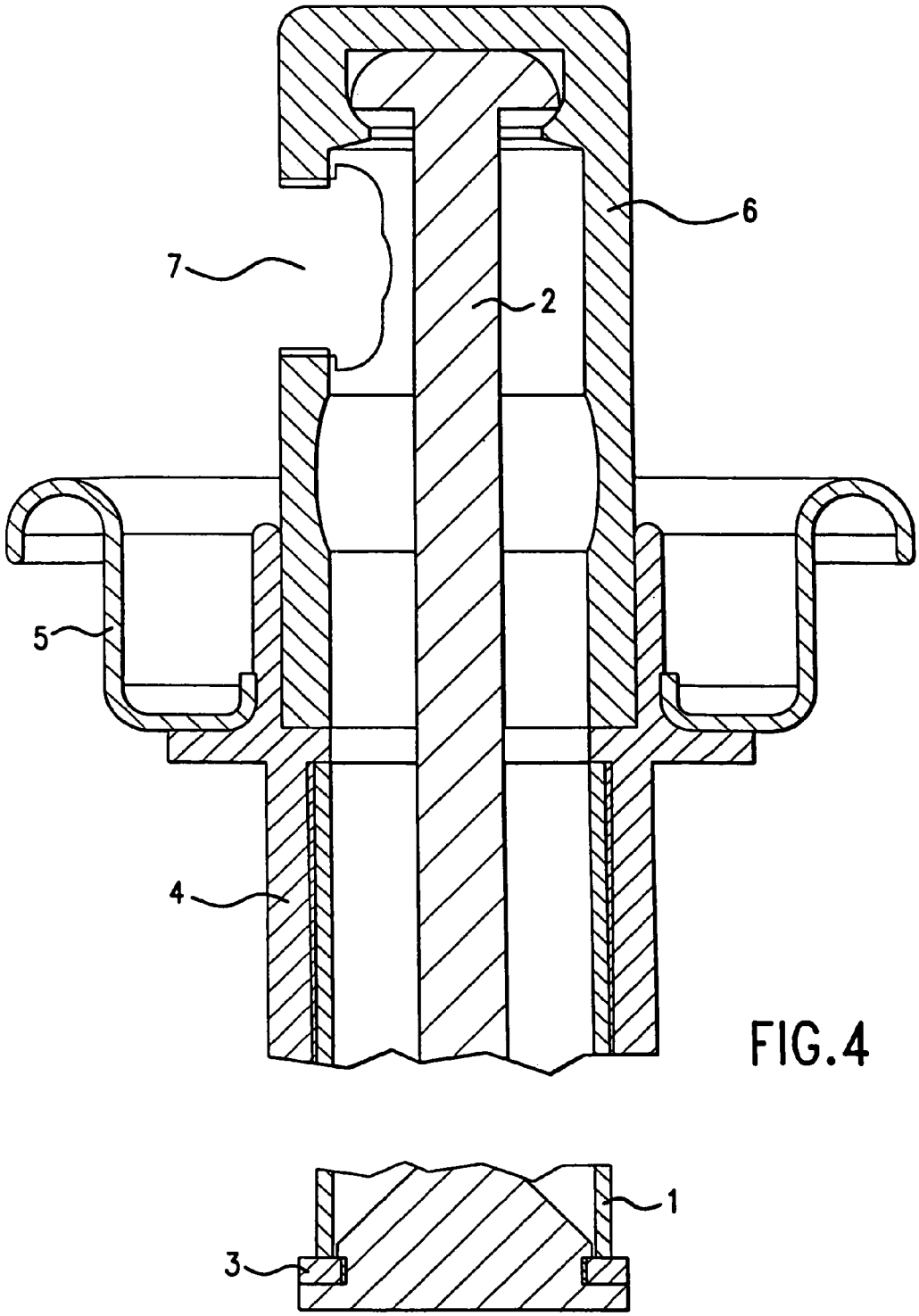
FIG. 4 is a cross-sectional view of a valve assembly in accordance with an embodiment of the present invention.
Figure 5:
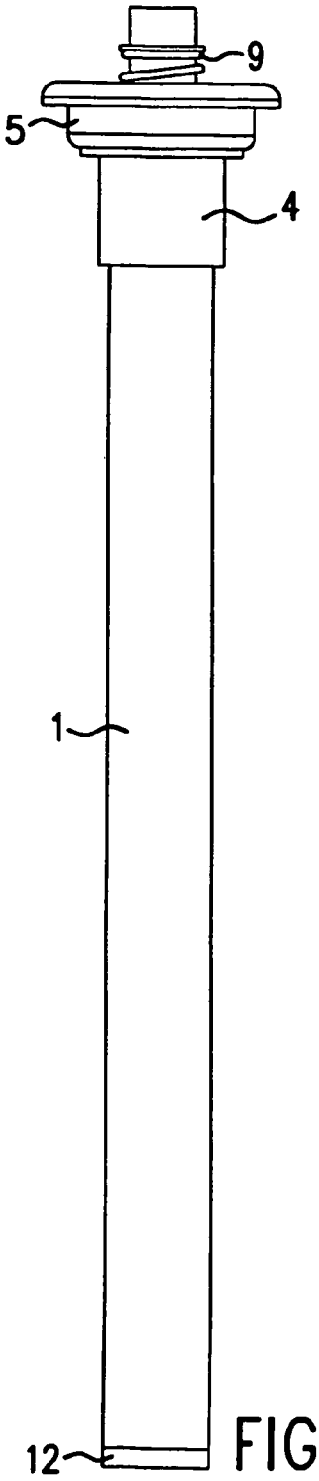
FIG. 5 is a perspective view of a valve assembly in a closed position in accordance with an embodiment of the present invention.
Figure 6:
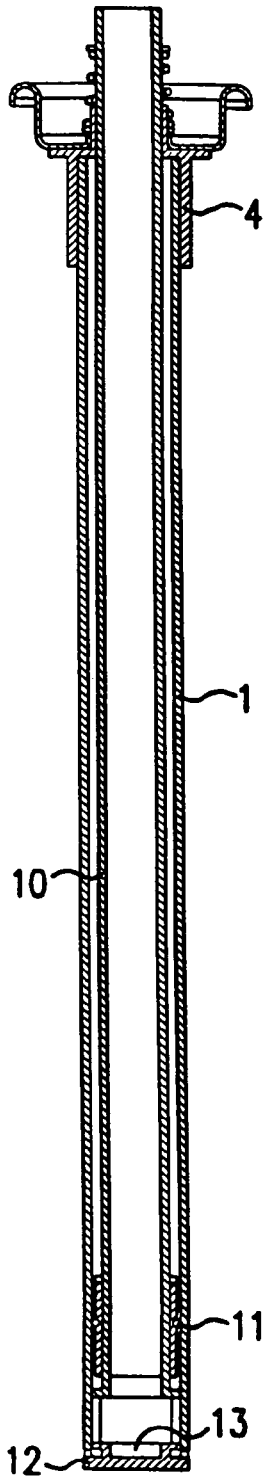
FIG. 6 is a cross-sectional view of a valve assembly in a closed position in accordance with an embodiment of the present invention.

In FIGS. 2 and 4, an apertures on the actuator 6 forms a nozzle opening 7, in which a dispersing apparatus, such as a nozzle cap or a dispensing tube, may be attached or screwed. A rod 2 is disposed inside the dip tube 1 in a way that allows the rod 2 to move within the dip tube 1 along its length. The actuator 6 is coupled to the top end of the rod 2, so that when the actuator 6 is depressed, the rod 2 moves downward within the dip tube 1. A sealing member 3 is coupled to the bottom end of the rod 2, so that when the rod 2 is in an up position, i.e., the actuator 6 is not depressed, the sealing member 3 forms a tight-seal with the bottom opening of the dip tube 1. However, when the rod 2 is in a down position, i.e., the actuator 6 is depressed, the sealing member 3 exposes the bottom opening of the dip tube 1 to the heavy and particulate material inside the container, and the aerosol within the container will force the texture material through the bottom opening of the dip tube 1, up through the dip tube 1, and out of the container through the nozzle opening 7. The heavy and particulate material may be a variety of sprayable materials, including viscous materials or materials having large particulates, like that of stucco.

The cup 5 acts as a guide to limit how far down the actuator 6 may be depressed, and in turn how far down the rod 2 may travel within the dip tube 1. If the actuator 6 is depressed too far, the bottom end of the rod 2 may come in contact with the bottom surface of the container, which may result in damage to the container. The cup 5 is also adapted to fit securely over the top portion of an aerosol spray can and may also provide a surface for attaching the valve assembly to the aerosol spray can.

The placement of the valve opening at the bottom of the container, as opposed to near the top of the container, as described in the prior references, drastically reduces the clogging and packing of the valve opening as experienced by traditional aerosol spray cans when spraying texture materials containing large particulates, such as stucco. Further description of an example of a heavy and particulate material is disclosed in U.S. Pat. No. 6,225,393, entitled, "Hardenable Texture Material in Aerosol Form," incorporated herein by reference. In addition to being capable of spraying stucco-like materials, the valve assembly is also particularly useful in spraying other types of materials having large particulates or high viscosities, including fire suppressant materials. These materials having large particulates or high viscosities may be dispensed directly from the valve system of an aerosol dispensing container. The aerosol dispensing container is preferably a size that allows it to be hand held and may be operated with one hand.

Ideally, the actuator 6 is made out of an elastic material, such as rubber, so as to allow the retention of the rod 2 in the up position when the actuator 6 is not depressed. The actuator 6 may also be made of a non-elastic material, but there may be a resilient member, such as a spring, coupled to the bushing 4 and engaging the actuator 6 so as to spring-load the actuator 6. The sealing member 3 should be made of a material, such as a rubber, that will allow the sealing member 3 to form a tight-seal with the bottom opening of the dip tube 1 so as to prevent any entry of the texture material and the aerosol carrier into the dip tube 1 when the rod 2 is in the up position, i.e., when the actuator 6 is not being depressed.

FIGS. 5 to 9 show another embodiment of the present invention. A dip tube 1 is coupled to a bushing 4, which may also be coupled to a cup 5. A spring member 9 may be coupled to the bushing 4 to spring-load the actuator 6 engaging the spring member 9 on the bushing 4.

An interior tube 10 with a top end and a bottom is disposed inside the dip tube 1 in a way that allows the interior tube 10 to move within the dip tube 1 along its length. The actuator 6 is coupled to the top end of the interior tube 10, so that when the actuator 6 is depressed, the interior tube 10 moves downward within the dip tube 1. There is at least one orifice 13 at the bottom end of the interior tube 10 so as to allow the heavy and particulate material from inside the container to flow up through the interior tube 10 and out of the nozzle opening. A top O-ring 11 is coupled to the interior tube 10 adjacent to and just above the at least one orifice 13 so as to form a seal to prevent any bypass of the heavy and particulate material from the container into the dip tube 1 when the interior tube 10 is in a down position. A bottom O-ring 12 is coupled to the bottom end of the interior tube 10 so as to seal off and close the valve assembly when the interior tube 10 is in an up position.

As described above, the cup 5 may act as a guide so as to limit how far down the actuator 6 may be depressed, as well as provide a surface for attaching the valve assembly to the container.

Figure 7A:
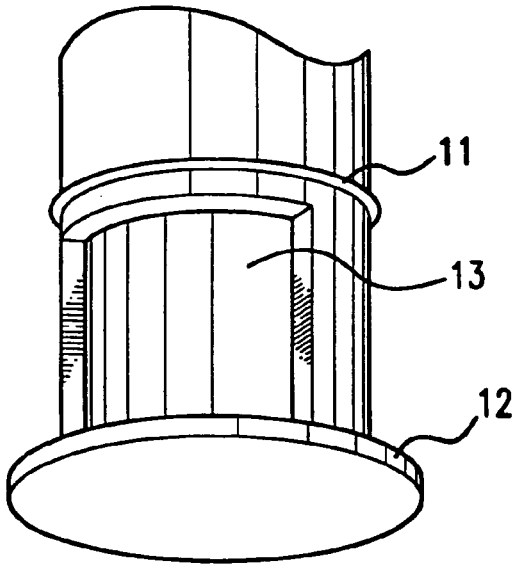
FIGS. 7A and 7B illustrate perspective views of a position of a valve assembly in accordance with an embodiment of the present invention.
Figure 7B:
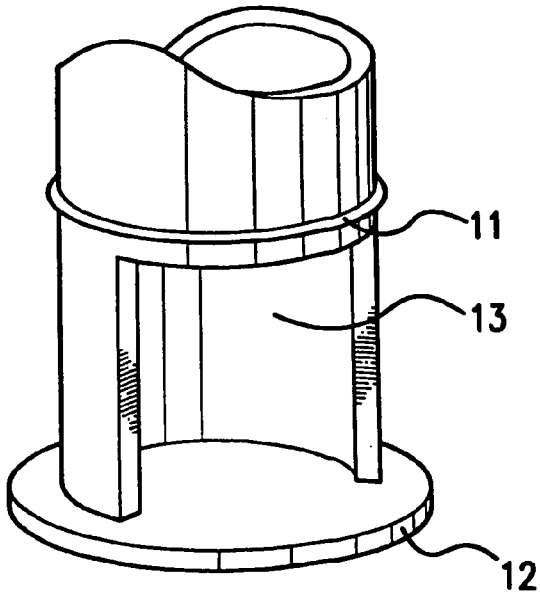
Figure 8:
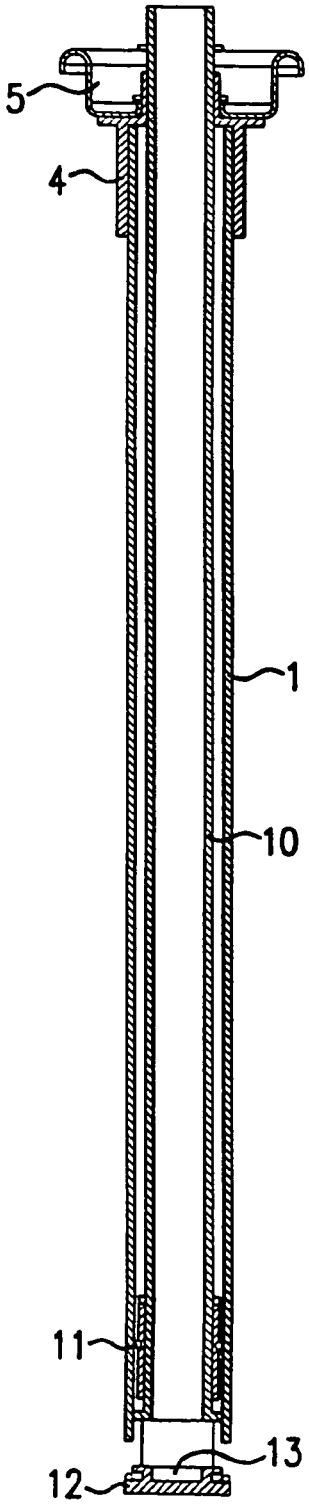
FIG. 8 is a cross-sectional view of a valve assembly in an opened position in accordance with an embodiment of the present invention.
Figure 9:
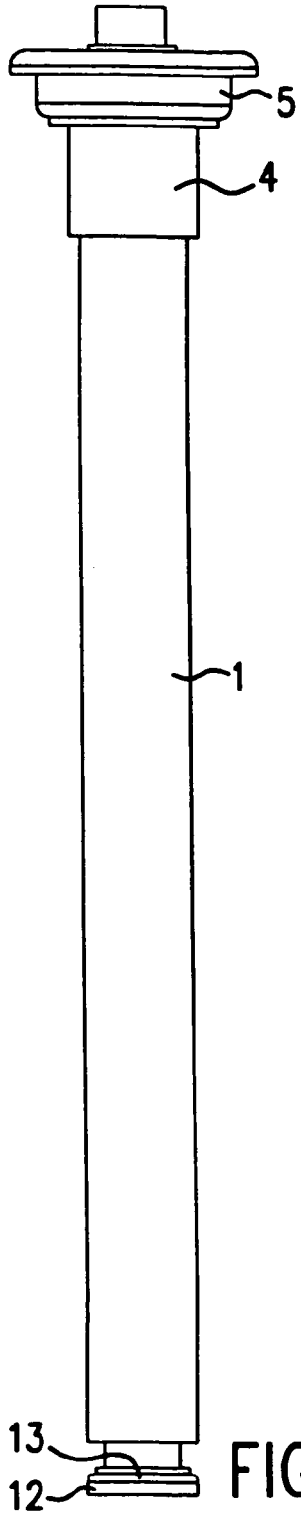
FIG. 9 is a perspective view of a valve assembly in an opened position in accordance with an embodiment of the present invention.

FIGS. 7A and 7B illustrate perspective views of a portion of a valve assembly in accordance with an embodiment of the present invention. As may be seen in FIG. 7B, when orifice 13 is aligned with orifice 14, an opening is created.

Figure 10:
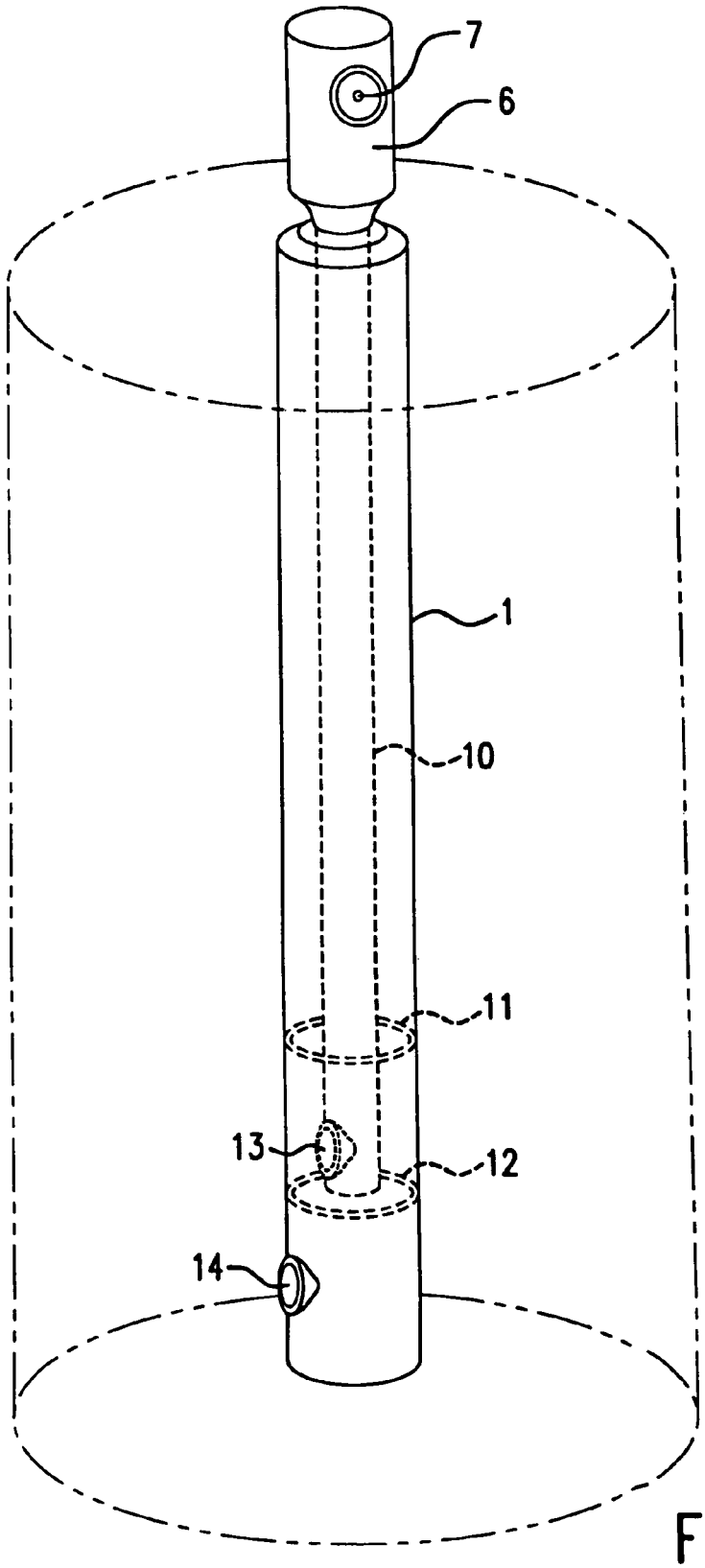
FIG. 10 is a cross-sectional view of a valve assembly in accordance with an embodiment of the present invention.

FIG. 10 shows yet another embodiment of the present invention. There is at least one exterior orifice 14 on the dip tube 1 that is adapted to be in flow alignment with the at least one orifice 13 of the interior tube 10. Therefore, when the actuator 6 is depressed and the interior tube 10 is lowered to its open position, the at least one orifice 13 of the interior tube 10 aligns with the at least one orifice 14 on the dip tube 1 so that the material inside the container 17 may flow through the exterior orifice 14 and into the at least one orifice 13 of the interior tube 10 and up through the interior tube 10 and out of the container through the nozzle opening 7. Similarly, there is a top O-ring 11 and a bottom O-ring 12, as described above, for sealing off the dip tube 1 to prevent any bypass of the heavy and particulate material from the container and for closing the valve assembly.

Figure 11:
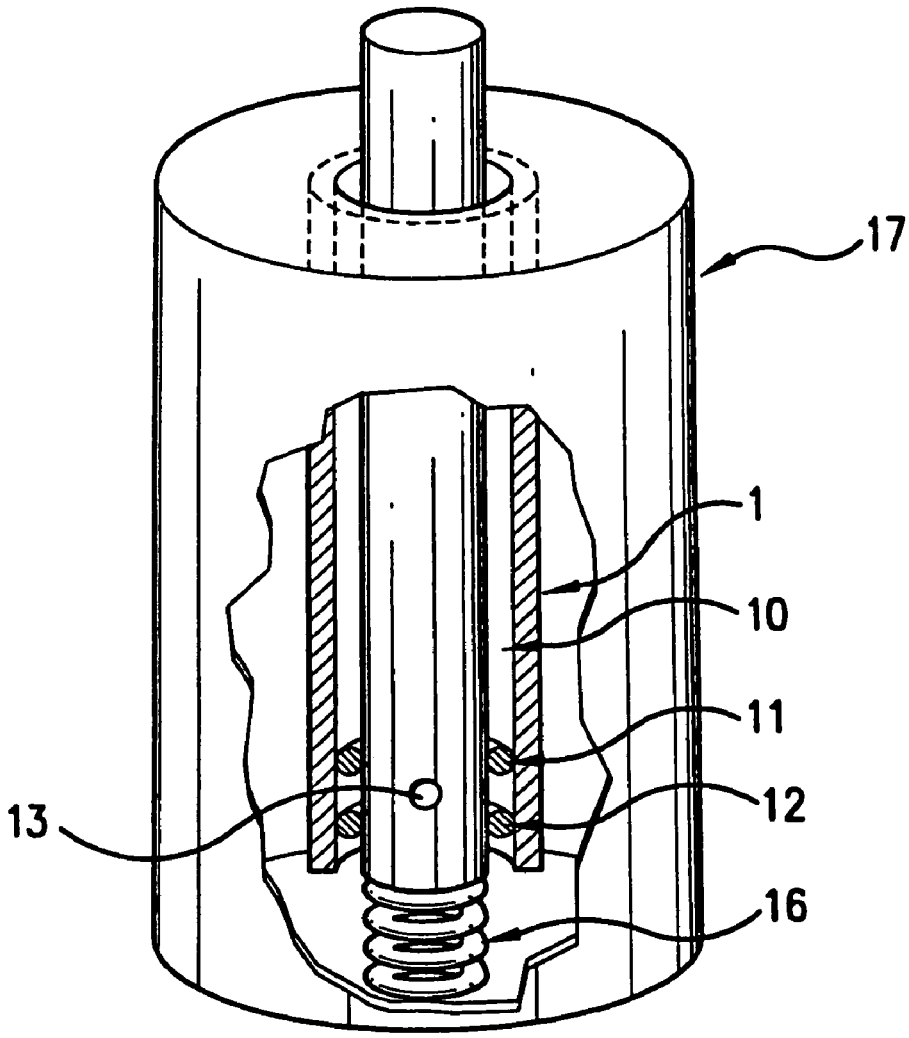
FIG. 11 is a cross-sectional view of a valve assembly in accordance with an embodiment of the present invention.
Figure 12:
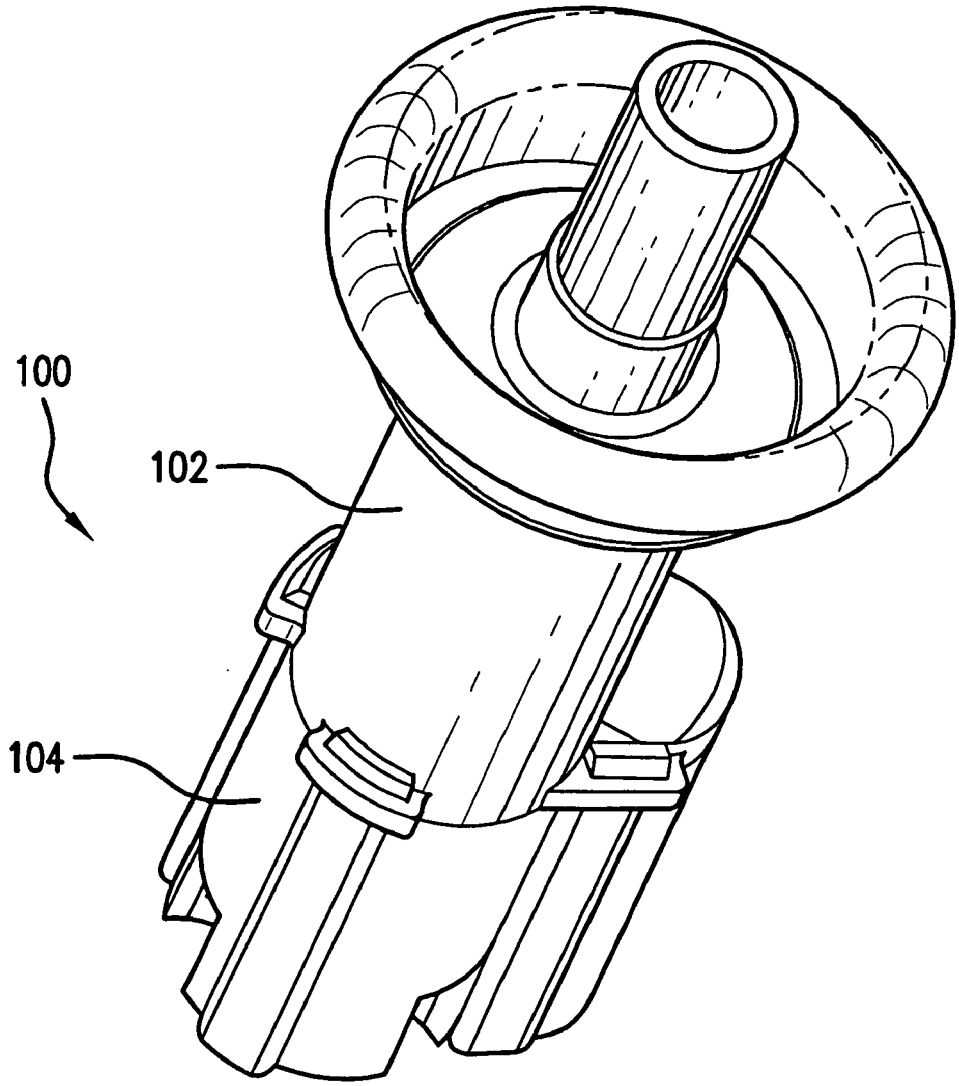
FIG. 12 is a side elevational view of a valve assembly in accordance with an embodiment of the present invention.

FIG. 11 shows yet another embodiment of the present invention. In this embodiment, a resilient member 16, shown here as a spring, is located at the bottom of the container 17. One end of the resilient member 16 is adjacent to the bottom of the container. The resilient member 16 may be attached to, or may abut, the bottom of the container 17. The second end of the resilient member 16 may be attached to, or may abut, the inner tube 10. This resilient member 16 will serve to spring-load the actuator and will prevent the inner tube 10 from remaining in its lowered position beyond the time required by the user. The resilient member 16 may also serve as a type of anchor or stabilizer for the inner tube 10 and dip tube 1. This will help to prevent any movement of the inner tube 10 and dip tube 1 that may cause a leakage where the inner tube 10 and the dip tube 1 meet the top of the container 17. While FIG. 11 shows the resilient member 16 being used with the embodiment of the present invention that has a inner tube 10 and a dip tube 1, it should be understood that the spring could be used with any embodiment of the present invention to center the tube extending into the container, to provide support to the tube in the container, and to push the tube back towards the top of the can and spring-load the actuator.

The resilient member 16 is depicted in FIG. 11 as a coil or spring. However, it should be understood by one skilled in the art that this resilient member may be made from a rubber cylinder, a metal coil or any other means as are known in the art.

FIGS. 12–15 show another embodiment of the present invention. A valve assembly 100 includes an upper housing 102 and a lower housing 104. The lower housing 104 is divided into a vertical passageway 114 and a vertical compartment 116. The upper housing 102 may be generally cylindrical and includes a transverse opening 106 through the wall of the housing. The upper housing 102 also includes a side conduit 108 where, at one end 112, it is connected to the opening 106 and, at the other (free) end 110, it is in flow alignment and communication with the upper end 118 of the vertical passageway 114. Thus, the side conduit 108 is disposed between the upper housing 102 and the lower housing 114 at an angle sloping downwards from the horizontal. In a preferred embodiment, the upper and lower housings are coupled together by snap means 128*a*,128*b*, or other similar coupling means. In an alternative embodiment, upper housing 102 and lower housing 104 may be made as a unitary structure.

Figure 13:
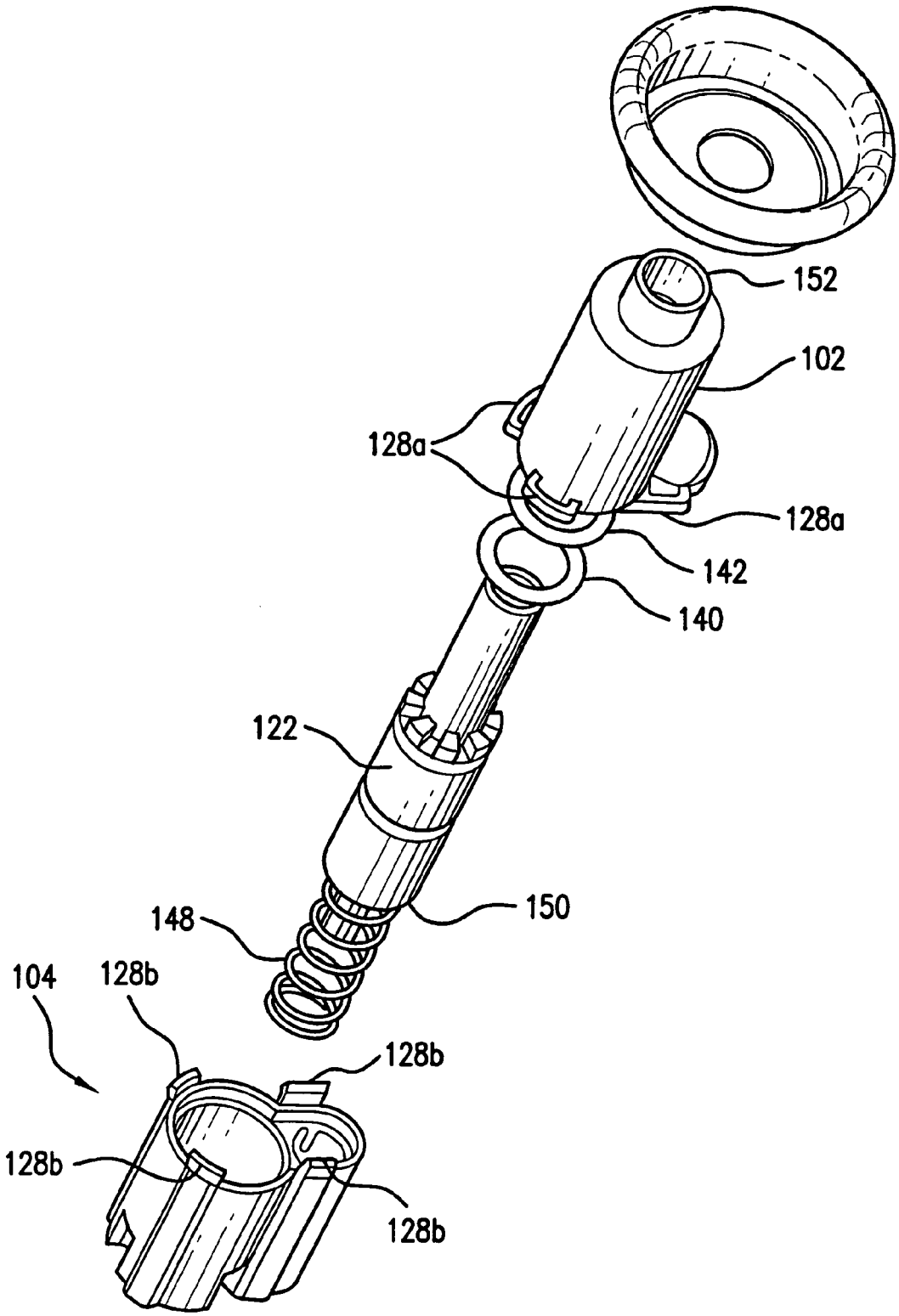
FIG. 13 is an exploded view of the valve assembly depicted in FIG. 12.
Figure 14C:
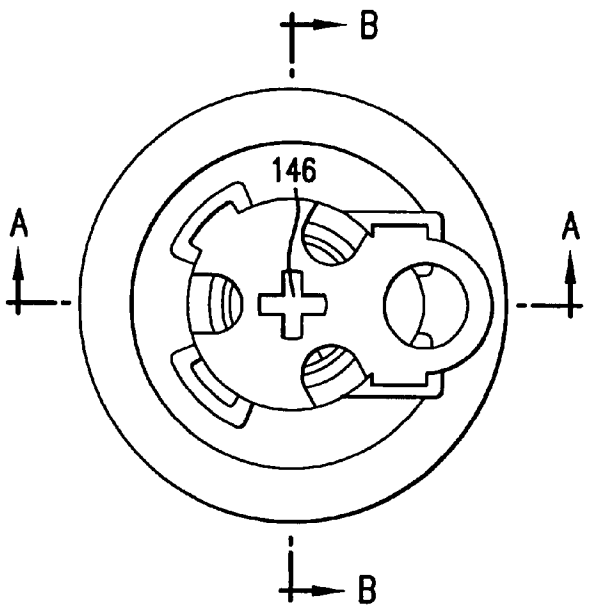
FIG. 14C is a top cross-sectional view of the valve assembly depicted in FIG. 14A.
Figure 14B:
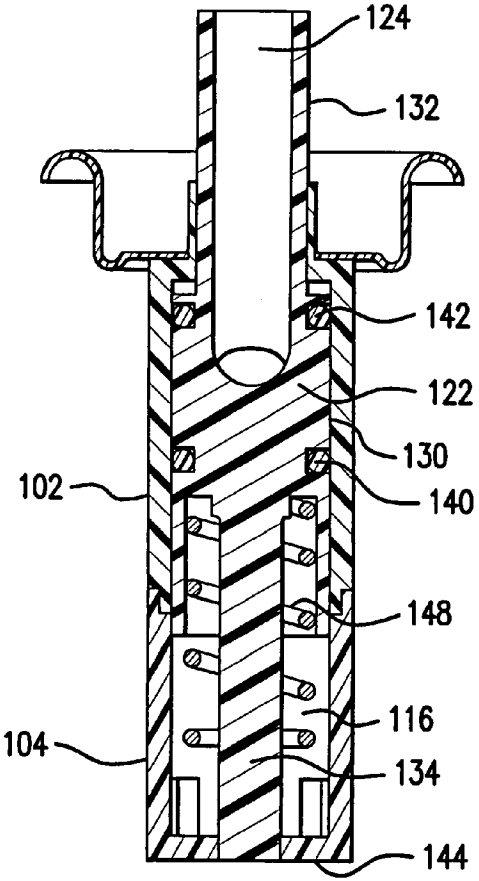
FIG. 14B is a rear cross-sectional view of the valve assembly depicted in FIG. 14A.
Figure 14A:
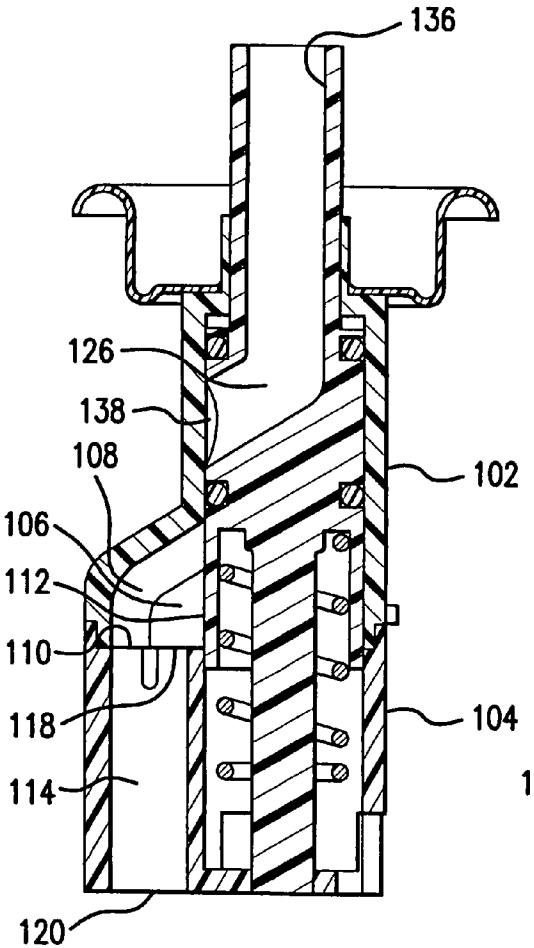
FIG. 14A is a side cross-sectional view of a valve assembly in an unactuated position in accordance with an embodiment of the present invention.

As shown in FIGS. 13 and 14A–B, a spool 122 having a middle portion 130, an upper elongated member 132, and a lower elongated member 134 moves vertically within the upper housing 102 and the vertical compartment 116 of the lower housing 104. The middle portion 130 is generally cylindrical and defines a transverse opening 138 through its wall. A channel 124 having a straight upper portion 136 and an angled lower portion 126 is defined through a length-wise portion of the upper elongated member 132. The upper housing 102 includes a bushing 152 on its top surface, such that the bushing 152 is concentric with, and disposed around, the channel's straight upper portion 136.

In a preferred embodiment, the straight upper portion 136 of the length-wise channel 124 is concentric with and, as such, constitutes the upper elongated member 132. As illustrated in FIGS. 14A and 15B, the lower portion 126 of the length-wise channel 124 is angled, so that it extends radially outwards in a downward-sloping manner, such that it connects to, and is in flow alignment and communication with, the opening 138 in the wall of the spool's middle portion 130. A first seal 140, such as an O-ring, is coupled to the exterior of the middle portion 130 of the spool 122 just below the point where the angled lower portion 126 meets the opening 138 so as to prevent passage of the sprayable material from the container 17 into the opening 138 or channel 124 when the spool 122 is up, i.e., when the actuating mechanism is in an unactuated position (see FIGS. 14A–B). Similarly, a second seal 142 (e.g., an O-ring) is coupled to the exterior of the middle portion 130 of the spool 122 just above the point where the angled lower portion 126 meets the opening 138 so as to prevent passage of the sprayable material from the container 17 into the upper housing 102 when the spool 122 is down, i.e., when the actuating mechanism is in an actuated position (see FIGS. 15A–B).

The valve assembly 100 further includes a resilient member 148 to bias the actuating mechanism, including the spool 122 towards an unactuated position, i.e., in an up position. In one embodiment, the resilient member 148 is a spring that is disposed around the spool's lower elongated member 134. In this embodiment, one end of the spring engages an undersurface 150 of the spool's middle portion 130, and the other end engages the bottom surface 144 of the vertical compartment 116. In this manner, the spool 122 is normally spring-loaded towards an unactuated position, and its vertical movement is restricted as determined, e.g., by the properties of the spring.

Embodiments of the invention include a guiding mechanism to ensure that, in an actuated position, the openings 106 and 138 line up, so that the side conduit 108 and the angled lower portion 126 of the channel 124 are in flow alignment and communication. This, in effect requires that the spool 122 be prevented from twisting, or rotating around its longitudinal axis. In one embodiment, this is achieved by including, in the bottom surface 144 of the vertical compartment 116, an aperture 146 having generally a non-circular shape. In addition, the spool's lower elongated member 134 has a cross-section in the shape of the aperture 146 and rides within the aperture. Thus, in the example shown in FIG. 14C, the aperture 146 is in the shape of a plus sign, although any other non-circular geometry may also be used. In operation, the lower elongated member 134 extends through, and is engaged by, the aperture 146, so that the latter guides the movement of the former.

Figure 15A:
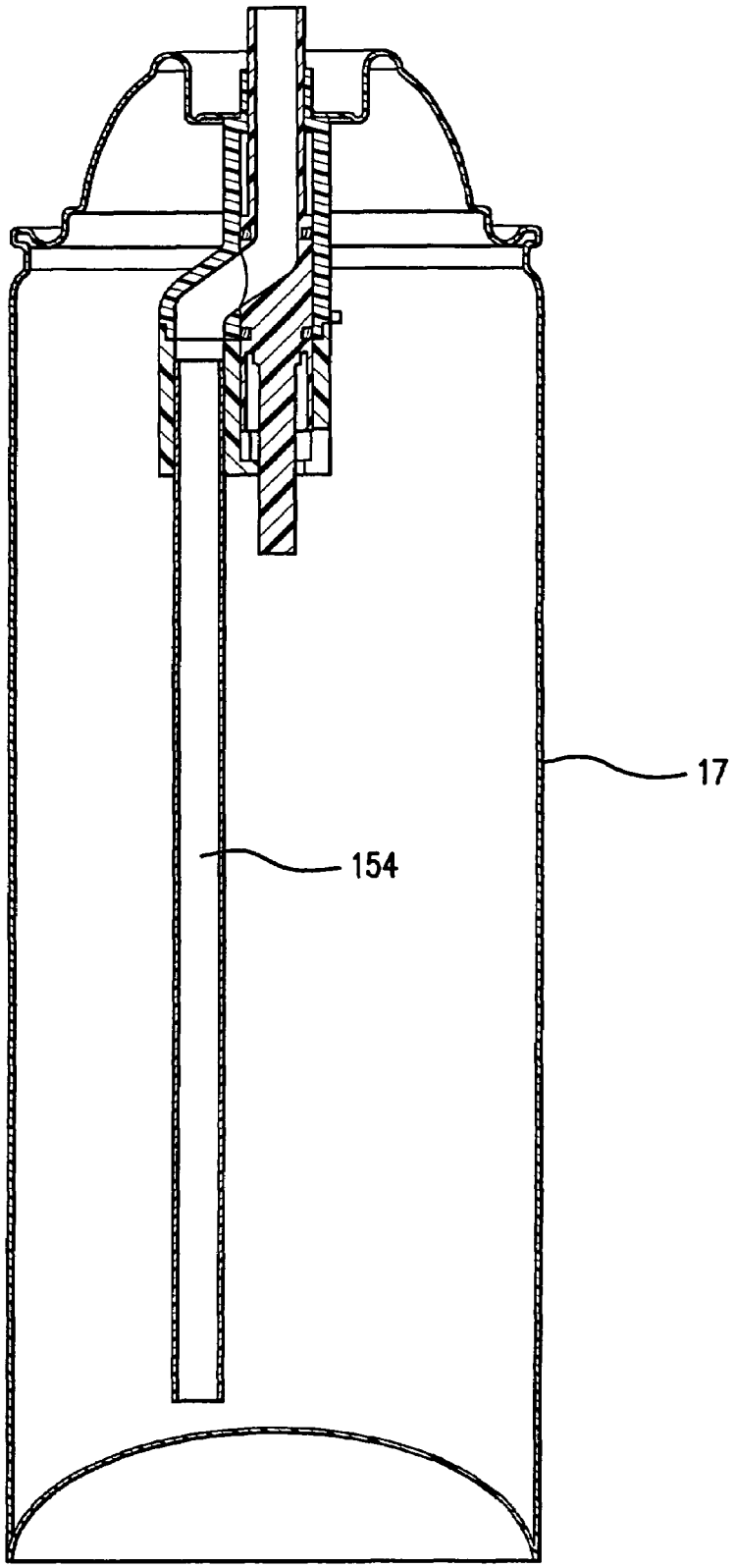
FIG. 15A is a cross-sectional view of a valve assembly in an actuated position in accordance with an embodiment of the present invention.
Figure 15B:
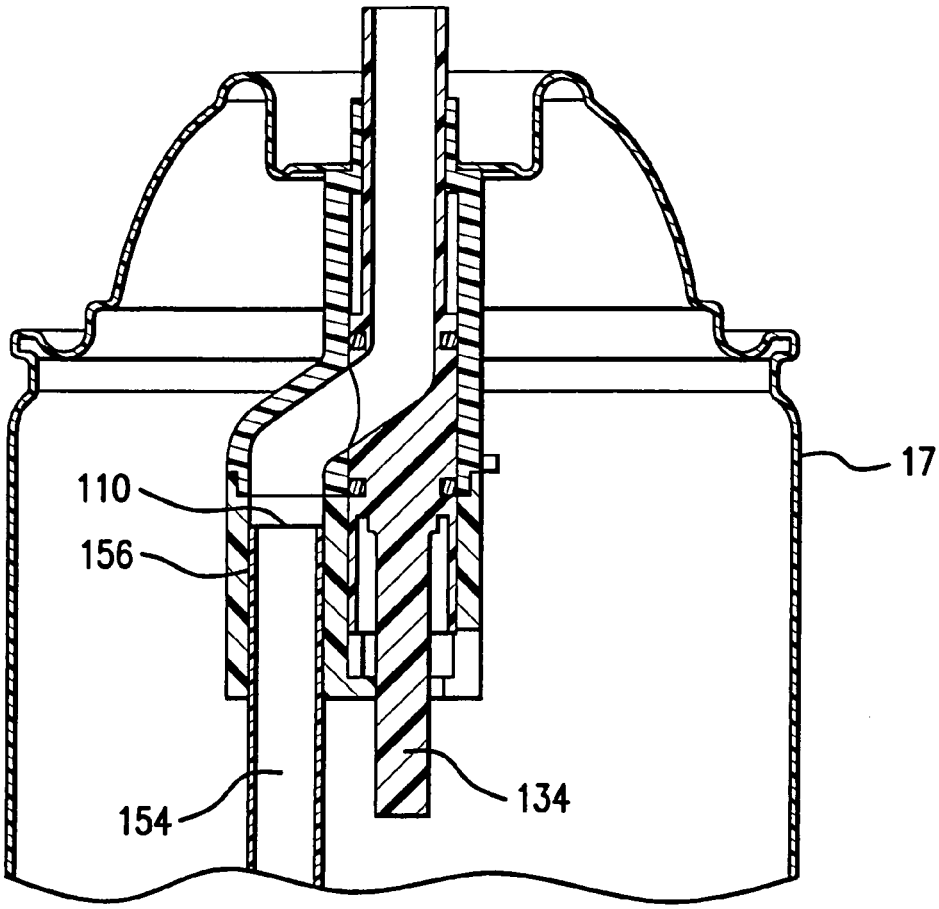
FIG. 15B is an enlarged view of the top portion of the valve assembly shown in FIG. 15A.

FIG. 15A shows a cross-sectional view of a valve assembly in an actuated position within a container 17. As depicted more clearly in FIG. 15B, a dip tube 154 is inserted through a lower end 120 of the vertical passageway 114 such that an upper portion of the dip tube is housed within the vertical passageway 114, and the upper end 156 of the dip tube is disposed adjacent and in flow alignment and communication with the free end 110 of the side conduit 108.

In operation, to initiate of the texture material, the upper elongated member 132 of the spool 122 is depressed until the openings 106 and 138 are aligned, and the side conduit 108 and angled lower portion 126 are parallel and in flow communication. The guiding mechanism described above ensures that the spool 122 is lowered without twisting. Once the openings 106 and 138 are aligned, the propellant within the container 17 forces the texture material through the bottom opening of the dip tube 164, up through the dip tube and the side conduit 108, and out of the container through the angled lower portion 126 and the upper straight portion 136 of the channel 124. As was noted with respect to the embodiments previously described, the heavy and particulate texture material may be a variety of sprayable materials, including viscous materials or materials having large particulates, such as stucco. To terminate spraying of the texture material, the upper elongated member is released, at which time the resilient member 148 forces the spool 122 upwards and towards the unactuated position, where the openings 106 and 138 are no longer aligned.

Although embodiments shown in FIGS. 12–15 depict a valve assembly that is placed near the top of container, the invention may be practiced by placing the valve assembly at substantially any point between the top and bottom of the container. This flexibility in placement of the valve assembly is made possible because the side-feeding feature of the invention, in combination with the side-fitting dip tube, allows elimination of the gasket that is required by traditional aerosol spray cans, and yet provides for uptake of the texture material from the bottom of the can.

Nevertheless, placement of the valve assembly near the top of the container may be desirable, and preferred. For example, such placement provides for a much simpler and faster assembly, as well as a reduction in the amount of gas that is lost. In addition, placement of the dip tube on the side eliminates the need to build different sizes of valve assemblies to fit a range of container sizes. In effect, the invention allows for production of a single size of the valve assembly, wherein dip tubes of various lengths can be used according to the intended container size. As such, the invention also provides a reduction in size and costs associated with the use of a multiplicity of container sizes.

Figure 16A:
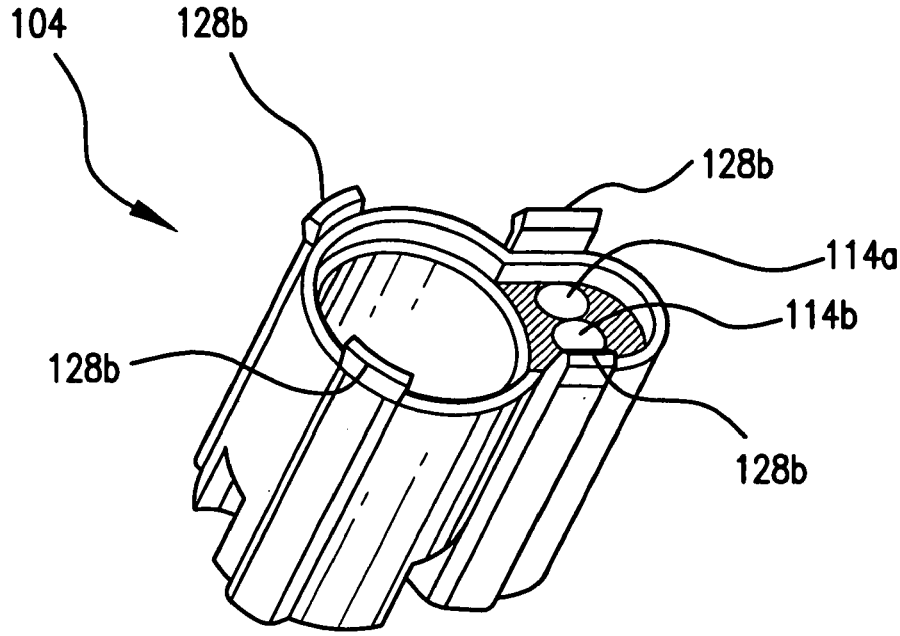
FIG. 16A is a perspective view of a lower housing according to an embodiment of the present invention.

As shown in FIG. 16A, the lower housing 104 may include two (or more) vertical passageways 114*a*,114*b*. The passageways may be situated side by side, and in various orientations. Thus, FIG. 16A shows passageways 114*a* and

Figure 16B:
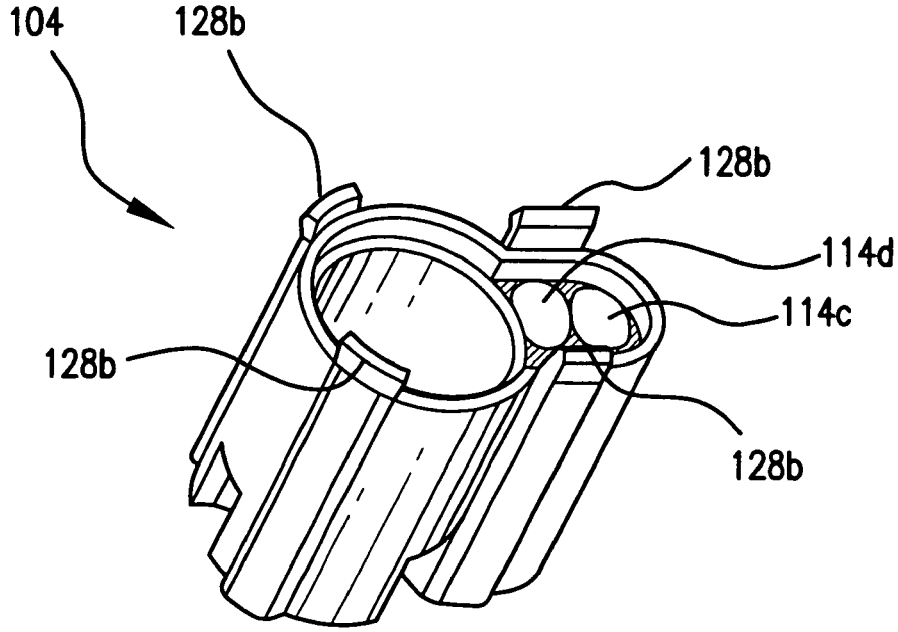
FIG. 16B is a perspective view of a lower housing according to another embodiment of the present invention.

114*b* oriented in one direction, while FIG. 16B shows passageways 114*c* and 114*d*, oriented about 90 degrees from the position depicted in FIG. 16A. It should be understood that FIGS. 16A and 16B depict illustrative examples only, and that the vertical passageways may have any other orientation within the lower housing 104. In addition, while, in a preferred embodiment, each of the vertical passageways 114*a*–114*d* has a circular cross section, the present invention may also be practiced with these passageways having non-circular cross sections.

Figure 17:
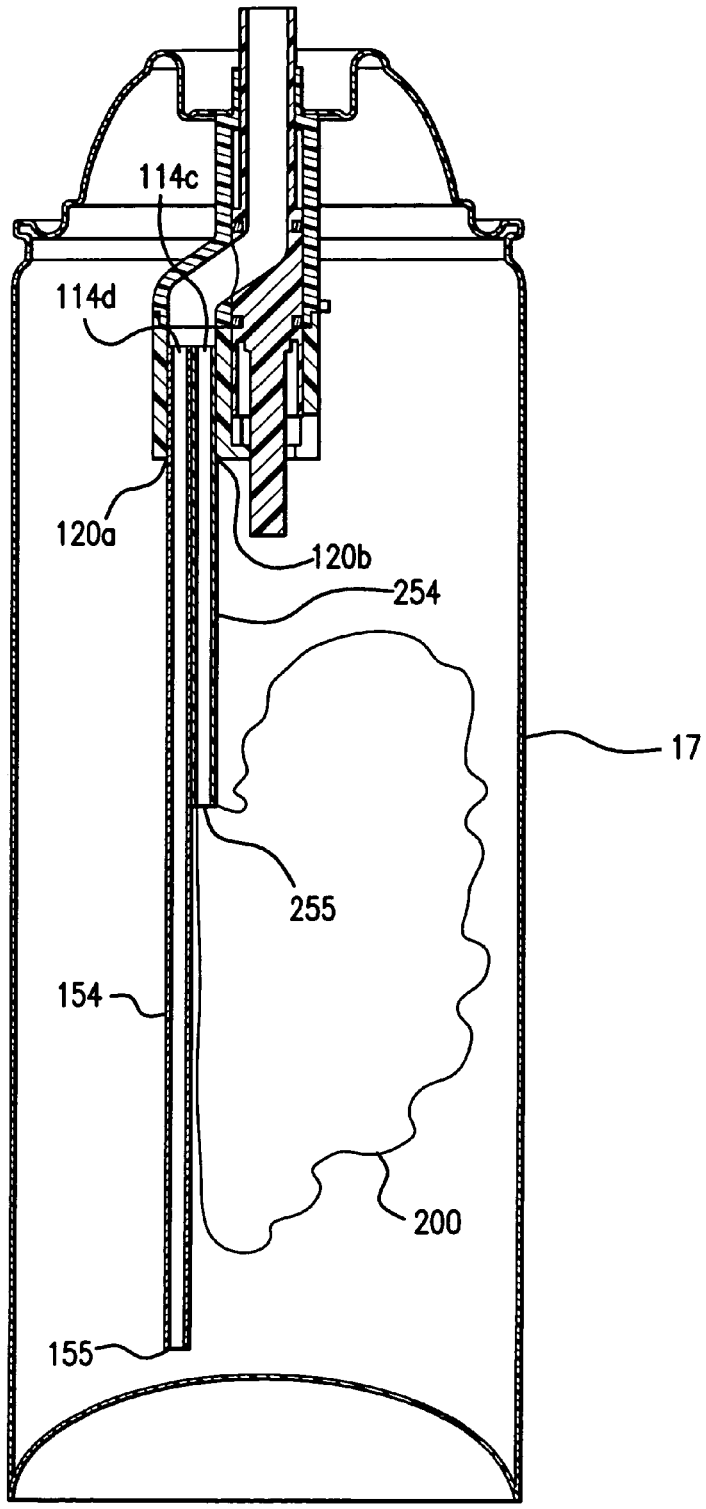
FIG. 17 is a cross-sectional view of a valve assembly in an actuated position in accordance with an embodiment of the present invention.

FIG. 17 shows a cross-sectional view of a valve assembly in an actuated position within the container 17, wherein a lower housing 104 according to FIG. 16B has been employed for illustrative purposes. Here, a first dip tube 154 is inserted through a lower end 120*a* of the first vertical passageways 114*c* such that an upper portion of the dip tube is housed within the first vertical passageway 114*c*, and the upper end of the dip tube is disposed adjacent and in flow alignment and communication with the free end 110 of the side conduit 108. The lower end 155 of the first dip tube 154 extends generally downwards and is directly in contact/communication with the interior of the container 17.

Similarly, a second dip tube 254 is inserted through a lower end 120*b* of the second vertical passageway 114*d* such that an upper portion of the dip tube is housed within the second vertical passageway 114*d*, and the upper end of the dip tube is disposed adjacent and in flow alignment and communication with the free end 110 of the side conduit 108. Here, however, the lower end 255 of the second ip tube 254 is connected to a storage member, such as a sack or a pouch, 200, which is contained within the container 17.

The above configuration allows for two different materials, or two portions (or fractions) of the same material, to be sprayed out of the same container. Thus, in operation, to initiate spraying, the upper elongated member 132 of the spool 122 is depressed, as before, until the openings 106 and 138 are aligned, and the side conduit 108 and angled lower portion 126 are parallel and in flow communication. The guiding mechanism described above ensures that the spool 122 is lowered without twisting. Once the opening 106 and 138 are aligned, the propellant within the container 17 forces material through the bottom openings of the first dip tube 154 and second dip tube 254, up through the respective dip tubes and the side conduit 108, and out of the container through the angled lower portion 126 and the upper straight portion 136 of the channel 124.

The storage member 200 connected to the second dip tube 254 may include its own propellant. Thus, compressed gasses functioning as propellants may be introduced into the container 17 and storage member 200 by, e.g., undercapping the propellant into the container (i.e., filling the container with the propellant and then sealing it quickly) and/or filling the storage member 200 and the container 17 with propellant through the valve mechanism atop the container.

As was noted with respect to the embodiments previously described, the heavy and particulate texture material may be a variety of sprayable materials, including viscous materials or materials having large particulates, such as stucco. In addition, the container 17 may be filled with an oil-based material having a first color, while the storage member 200 is filled with a water-based material having a second color. In this way, when the actuating mechanism is operated, the two materials are sprayed without mixing, thereby creating separate color patterns on the sprayed area. Moreover, the container may be filled with a resin, while the storage member is filled with a catalyst, or the container may be filled with a urethane-type product (such as, e.g., plastic or rubber), while the storage member is filled with a blowing agent (such as, e.g., water or a hydrocarbon material).

It is noted that the relative lengths of the dip tubes shown in FIG. 17 are for illustrative purposes only, and either dip tube may be of various lengths, depending, e.g., on the overall dimensions of the container 17, the dimensions of the storage member 200, etc. In addition, the diameter of each of the dip tubes may be selected based, e.g., on the material(s) being sprayed.

Finally, the invention described herein may be used to spray more than two (fractions of) materials from a single container by including multiple vertical passageways, dip tubes, and storage members.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A valve assembly for use in an aerosol system, said valve assembly comprising:

an upper housing defining a first opening through the periphery thereof;

a side conduit having a free end, and an end connected to said first opening at an angle sloping downward from the horizontal;

a lower housing divided into a first vertical passageway for receiving a first dip tube, a second vertical passageway for receiving a second dip tube, and a vertical compartment, wherein each of said first and second passageways has an upper end and a lower end and said upper ends are in flow alignment with the free end of the side conduit so as to provide flow communication between the lower end of each said passageways and said first opening; and an actuating mechanism having a spool defining a lengthwise channel through a portion thereof, wherein said spool is configured to move vertically within said upper housing and said vertical compartment, and wherein a lower portion of said channel is angled so as to be in flow alignment with said conduit through said first opening when the actuating mechanism is in an actuated position, thereby allowing a sprayable material to flow through at least one of said passageways and said conduit and channel.

2. The valve assembly of claim 1, wherein, for each of said first and second dip tubes, an upper portion of the dip tube is housed by its respective vertical passageway such that an upper end of the dip tube is disposed adjacent and in flow communication with said free end of the side conduit.

3. The valve assembly of claim 2, wherein the lower end of the first dip tube is in direct communication with a first fraction of sprayable material housed within an aerosol container, and the lower end of the second dip tube is connected to a storage member within said aerosol container, said storage member housing a second fraction of sprayable material.

4. The valve assembly of claim 3, wherein the storage member is a pouch.

5. The valve assembly of claim 3, wherein said first and second fractions are portions of the same material.

6. The valve assembly of claim 3, wherein said first and second fractions are portions of different materials.

7. The valve assembly of claim 3, wherein the diameter of each of said first and second dip tubes is selected based on the material being sprayed.

8. The valve assembly of claim 3, wherein the material housed in the storage member is selected from the group consisting of a catalyst, a blowing agent, and a first colorant.

9. The valve assembly of claim 8, wherein said blowing agent is at least one of a member selected from the group consisting of water and a hydrocarbon material.

10. The valve assembly of claim 3, wherein the material housed in the aerosol container is selected from the group consisting of a resin, a urethane material, and a second colorant.

11. The valve assembly of claim 10, wherein said urethane material is selected from the group consisting of plastic and rubber.

12. The valve assembly of claim 1, wherein each of said first and second passageways has a circular cross-section.

13. The valve assembly of claim 1, wherein said lower housing is configured to be coupled to said upper housing.

14. The valve assembly of claim 13, wherein said lower and upper housings are coupled with snap means.

15. The valve assembly of claim 1, wherein, in the actuated position, said angled lower portion of said channel is parallel to said conduit.

16. The valve assembly of claim 1, said spool being disposed vertically and including a middle portion, an upper elongated member, and a lower elongated member, wherein a straight upper portion of said channel constitutes said upper elongated member, and said angled lower portion of said channel extends towards, and is in flow alignment with, a second opening in a wall of the spool's middle portion so as to allow flow alignment of said first and second openings when the actuating mechanism is in an actuated position.

17. The valve assembly of claim 16, further including a first seal disposed so as to prevent the flow of sprayable material into said second opening when the actuating mechanism is in an unactuated position.

18. The valve assembly of claim 17, wherein said seal is an O-ring disposed around said middle portion of said spool.

19. The valve assembly of claim 17, further including a second seal, said first and second seals being disposed below and above said second opening.

20. The valve assembly of claim 16, said vertical compartment including a bottom surface defining therethrough an aperture having a non-circular shape, wherein said lower elongated member of the spool has a cross-section in the shape of said non-circular aperture and extends through said aperture, said aperture engaging said lower elongated member to prevent rotation of said spool around the longitudinal axis thereof.

21. The valve assembly of claim 1, further including resilient means to bias said actuating mechanism towards an unactuated position, said resilient means engaging an undersurface of the spool's middle portion.

22. The valve assembly of claim 21, wherein said resilient means is a spring that is disposed around the spool's lower elongated member.

23. The valve assembly of claim 1, wherein said lower and upper housings constitute a unitary structure.

24. The valve assembly of claim 1, wherein said upper housing includes a bushing on a top surface thereof, said bushing being concentric with, and disposed around, said straight upper portion of said channel.

25. The valve assembly of claim 1, further including means for preventing rotation of said spool around the longitudinal axis thereof.

* * * * *